US009254048B2

(12) United States Patent
Chen

(10) Patent No.: US 9,254,048 B2
(45) Date of Patent: Feb. 9, 2016

(54) UNLOCKED-STATE RETENTION DEVICE AND SEAT ASSEMBLY HAVING THE SAME

(71) Applicant: BP CHILDREN'S PRODUCTS HK CO., LIMITED, Hong Kong (HK)

(72) Inventor: Hong-Bo Chen, Guangdong (CN)

(73) Assignee: BP CHILDREN'S PRODUCTS HK CO., LIMITED, Hong Kong (HK)

( * ) Notice: Subject to any disclaimer, the term of this patent is extended or adjusted under 35 U.S.C. 154(b) by 0 days.

(21) Appl. No.: 14/226,070

(22) Filed: Mar. 26, 2014

(65) Prior Publication Data

US 2014/0292050 A1 Oct. 2, 2014

(30) Foreign Application Priority Data

Mar. 29, 2013 (CN) ..... 2013 1 0110008

(51) Int. Cl.

| | |
|---|---|
| ***A47D 1/00*** | (2006.01) |
| ***A47C 4/02*** | (2006.01) |
| ***A47C 7/02*** | (2006.01) |

(52) U.S. Cl.

CPC . *A47D 1/006* (2013.01); *A47C 4/02* (2013.01); *A47C 7/02* (2013.01); *A47D 1/00* (2013.01)

(58) Field of Classification Search

CPC ..... A47D 1/006; A47C 4/02
USPC ..... 297/130, 256.1, 256.16, 344.18, 440.22
See application file for complete search history.

(56) References Cited

U.S. PATENT DOCUMENTS

| | | | | |
|---|---|---|---|---|
| 5,718,439 | A | 2/1998 | Wang | |
| 5,951,102 | A * | 9/1999 | Poulson et al. | 297/130 |
| 6,050,643 | A * | 4/2000 | Kain et al. | 297/344.18 |
| 6,089,653 | A * | 7/2000 | Hotaling et al. | 297/130 |
| 6,871,911 | B2 * | 3/2005 | Alexander, Jr. | 297/344.18 |
| 7,387,337 | B2 * | 6/2008 | Keegan et al. | 297/256.13 |
| 7,673,940 | B2 * | 3/2010 | Fritz et al. | 297/256.11 |
| 8,100,470 | B1 * | 1/2012 | Hu | 297/148 |
| 8,388,063 | B2 * | 3/2013 | Fiore et al. | 297/256.11 |

FOREIGN PATENT DOCUMENTS

WO WO 93/15634 8/1993

OTHER PUBLICATIONS

Search Report issued by EPO in European Counterpart Application No. 14162242.3 on Jul. 10, 2014.

* cited by examiner

*Primary Examiner* — Peter Brown
(74) *Attorney, Agent, or Firm* — Hamre, Schumann, Mueller & Larson, P.C.

(57) ABSTRACT

An unlocked-state retention device is adapted for use in a seat assembly. The seat assembly includes a base frame and a seat body, which is mounted removably on the base frame through a locking unit to lock or unlock the seat body relative to the base frame such that the seat body is placed in a locked state or an unlocked state. The unlocked-state retention device includes a pusher adapted to be disposed movably in one of the base frame and the seat body, and includes a push member to retract ably project from the one of the base frame and the seat body and to push the other one of the base frame and the seat body when the seat body is unlocked relative to the base frame.

9 Claims, 7 Drawing Sheets

UNLOCKED-STATE RETENTION DEVICE AND SEAT ASSEMBLY HAVING THE SAME

CROSS-REFERENCE TO RELATED APPLICATION

This application claims priority of Chinese Application No. 201310110008.9 filed an Mar. 29, 2013.

BACKGROUND OF THE INVENTION

1. Field of the Invention

The invention relates to an unlocked-state retention device, more particularly to an unlocked-state retention device adapted for use in a seat assembly.

2. Description of the Related Art

A conventional seat assembly includes a base frame, a seat body mounted removably to the base frame for supporting an infant seated thereon, and a locking unit for locking the seat body on the base frame. The locking unit includes a tongue that is mounted in the base frame, and a locking groove that is formed in the seat body. When the seat body is mounted on the base frame, the tongue is urged by a resilient member to project retractably into and engage the locking groove such that the seat body is not removable from the base frame. During separation of the seat body from the base frame, a user has to manually retain the tongue to be retracted in the base frame and disengaged from the locking groove against the resilient force of the resilient member. It is not convenient for a user to perform the abovementioned two actions (i.e., to retain the tongue at the retracted state and to separate the seat body from the base frame) at the same time.

SUMMARY OF THE INVENTION

Therefore, an object of the present invention is to provide an unlocked-state retention device that can overcome the aforesaid drawbacks of the prior art.

Accordingly, an unlocked-state retention device of the present invention is adapted for use in a seat assembly. The seat assembly includes a base frame and a seat body, which is mounted removably on the base frame through a locking unit to lock or unlock the seat body relative to the base frame such that the seat body is placed in a locked state or an unlocked state. The unlocked-state retention device includes a pusher adapted to be disposed movably in one of the base frame and the seat body, and includes a push member to retract ably project from the one of the base frame and the seat body and to push the other one of the base frame and the seat body when the seat body is unlocked relative to the base frame.

Another object of the present invention is to provide a seat assembly including an unlocked-state retention device.

Accordingly, a seat assembly of the present invention includes a base frame, a seat body, a locking unit and an unlocked-state retention device. The seat body is removably mounted on the base frame. The locking unit releasably interlocks the base frame and the seat body and is operable to lock the seat body relative to the base frame so that the seat body is placed in a locked state, where the seat body is not removable from the base frame, or to unlock the seat body relative to the base frame so that the seat body is placed in an unlocked state, where the seat body is removable from the base frame. The unlocked-state retention device is adapted to separate the seat body from the base frame and to thereby prevent the seat body from moving to the looked state when the seat body is in the unlocked state.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 6:
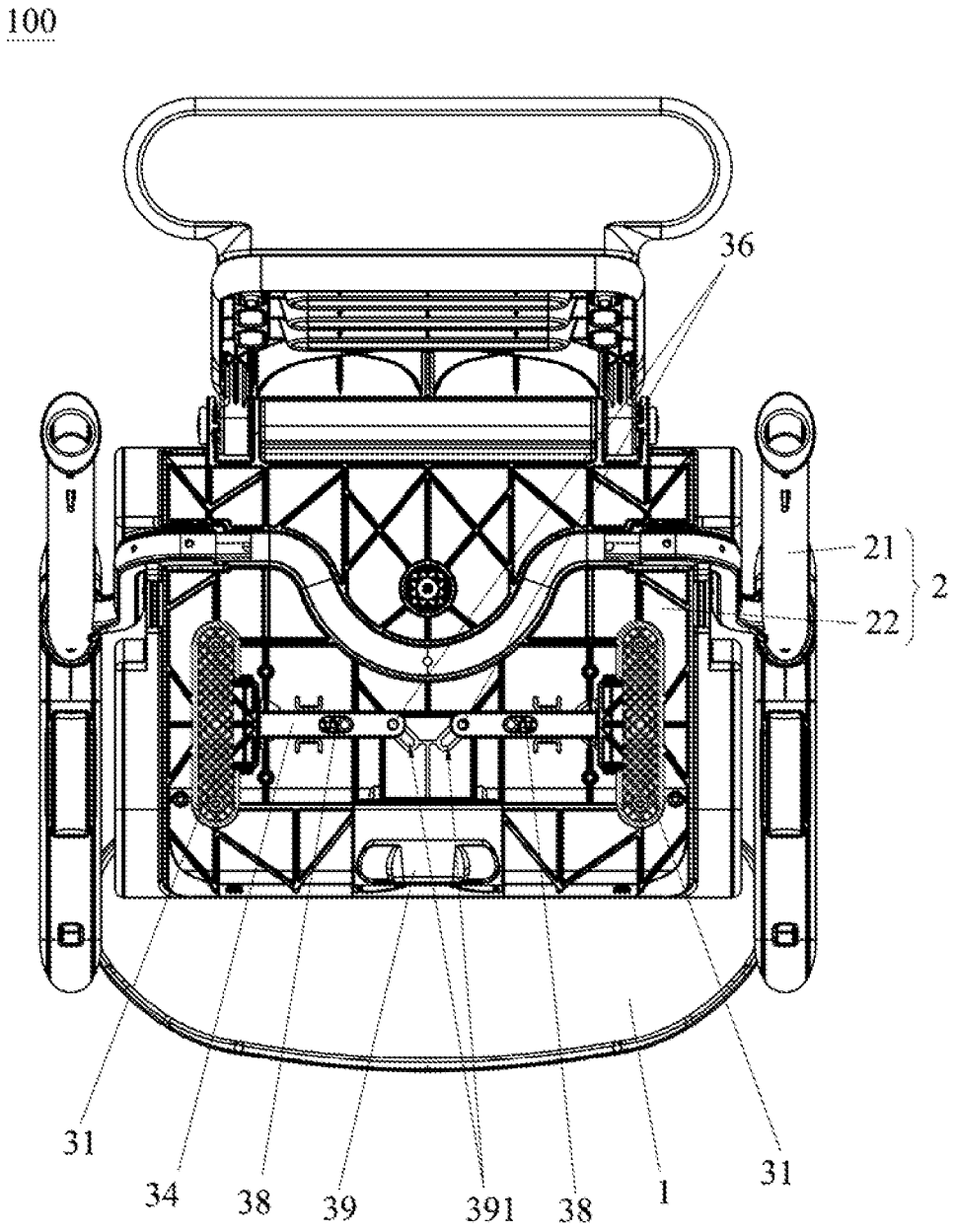
FIG. 6 is another bottom view of the seat assembly with a cover plate being removed.
Figure 7:
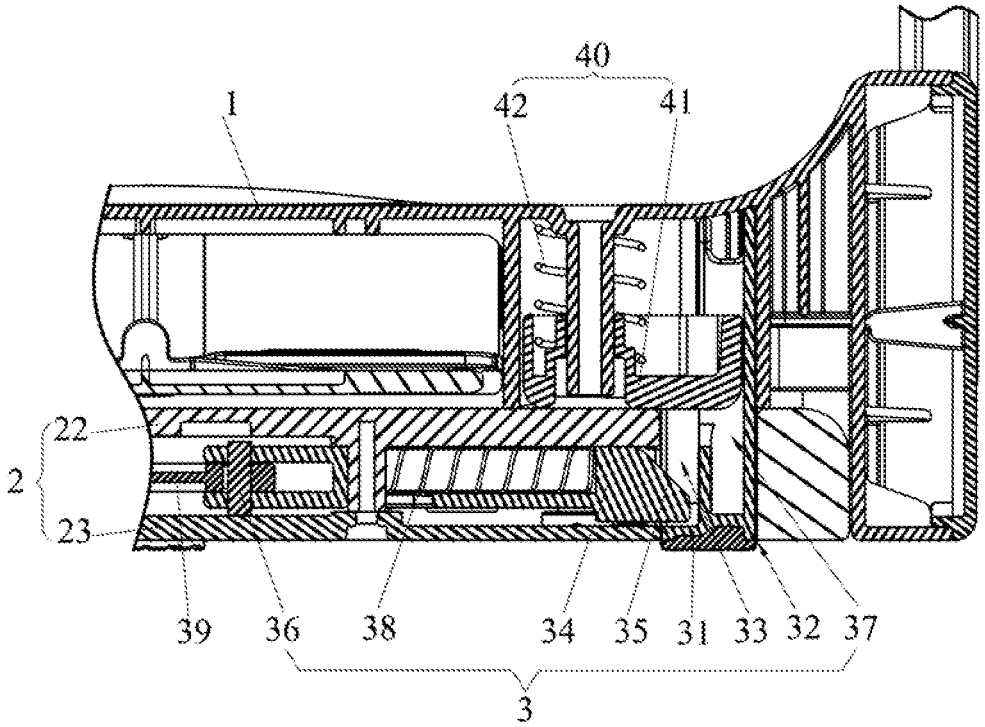
FIG. 7 is a fragmentary sectional view of the preferred embodiment.

As shown in FIGS. 1 to 7, a preferred embodiment of a seat assembly 100 according to the present invention is shown to include abase frame 2, a seat body 1 removably mounted on the base frame 2, a pair of locking units 3 (only one is shown in FIG. 7) releasably interlocking the base frame 2 and the seat body 1, and an unlocked-state retention device 4.

The base frame 2 includes a main frame 21, a base body 22 mounted on the main frame 21 to support the seat body 1, and a cover plate 23 (see FIGS. 5 and 7) mounted under the base body 22.

The locking units 3 are disposed respectively at left and right sides of the seat assembly 100, and are operable to lock the seat body 1 relative to the base frame 2 so that the seat body 1 is placed in a locked state, where the seat body 1 is not removable from the base frame 2, or to unlock the seat body 1 relative to the base frame 2 so that the seat body 1 is placed in an unlocked state, where the seat body 1 is removable from the base frame 2.

Each of the locking units 3 has a socket 32, a column body 31 and a tongue 34. In this embodiment, the socket 32 is formed in an upper surface of the base frame 2. The column body 31 projects downwardly from a bottom surface of the seat body 1 and extends into the socket 32 when the seat body 1 is disposed on the upper surface of the base frame 2. The tongue 34 is mounted slidably in the base frame 2 and is operable to move in a horizontal direction between a projecting position where a distal portion of the tongue 34 projects into the socket 32, and a retracted position where the distal portion of the tongue 34 is retracted from the socket 32. The column body 31 has a locking groove 33 that is engaged with the tongue 34 to place the seat body 1 in the locked state when the distal portion of the tongue 34 is at the projecting position.

The unlocked-state retention device 4 includes two pushers 40 that are disposed movably in the seat body 1, and that are disposed respectively at left and right sides of the seat body 1.

In this embodiment, each of the pushers 40 includes a push member 41 and a first resilient member 42. The push member 41 retractably projects from the bottom surface of the seat body 1 to push the upper surface of the base frame 2 when the seat body 1 is in the unlocked state so that the seat body 1 is slightly separated from the base frame 2. The push member 41 is retracted into the seat body 1 when the seat body 1 is in the locked state. The first resilient member 42 is configured as a compression spring, and is connected between the push member 41 and the seat body 1 to urge projection of the push member 41 when the seat body 1 is in the unlocked state. The unlocked-state retention device 4 thus keeps the seat body 1 to be separated from the base frame 2, thereby preventing the seat body 1 from moving to the locked state. In other embodiments of this invention, for each of the pushers 40, the first resilient member 42 and the push member 41 may be integrally formed as a single component, such as a U-shaped spring, which is forced to retract into the seat body 1 when the seat body 1 is in the locked state, and which automatically and resiliently projects to separate the seat body 1 from the base frame 2 when the seat body 1 is in the unlocked state.

The push member 41 of each of the pushers 40 is disposed in proximity to the column body 31 of a respective one of the locking units 3.

The column body 31 of each locking unit 3 further has a column bottom surf ace that is opposite to the bottom surface of the seat body 1, and a column side surface that extends from the column bottom surface to the bottom surface of the seat body 1 and that is formed with the locking groove 33.

Figure 1:
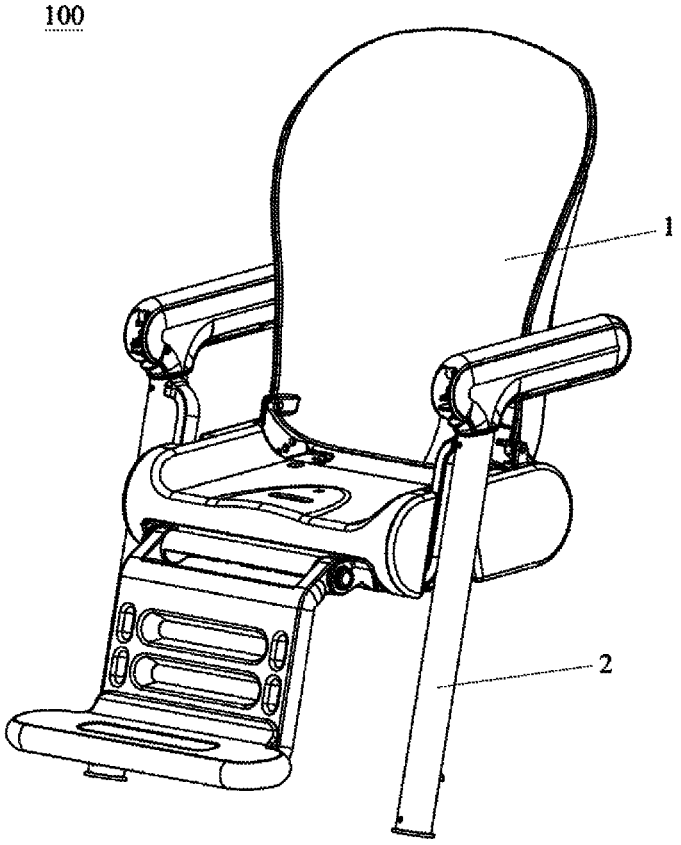
FIG. 1 is a perspective view of a preferred embodiment of a seat assembly according to the invention.
Figure 2:
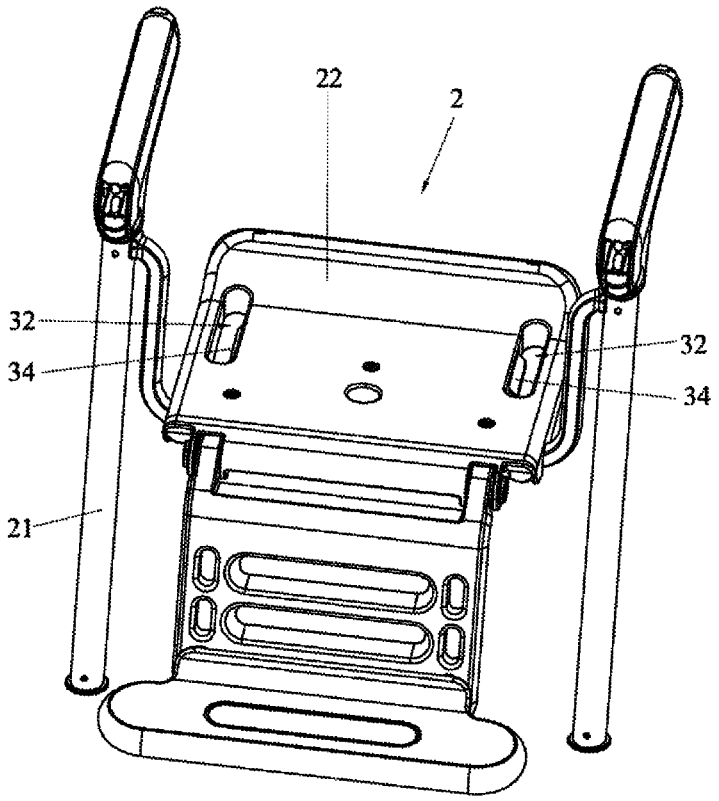
FIG. 2 is a perspective view of a base frame of the preferred embodiment.
Figure 3:
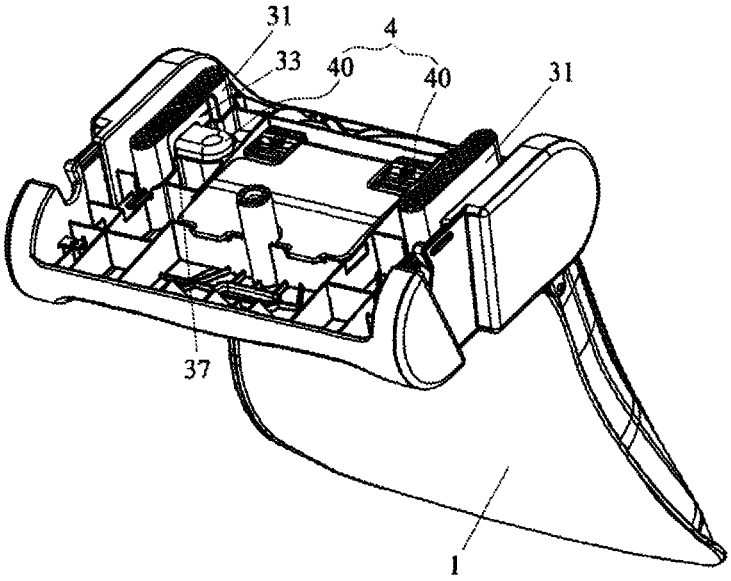
FIG. 3 is a perspective view of a seat body of the preferred embodiment.
Figure 4:
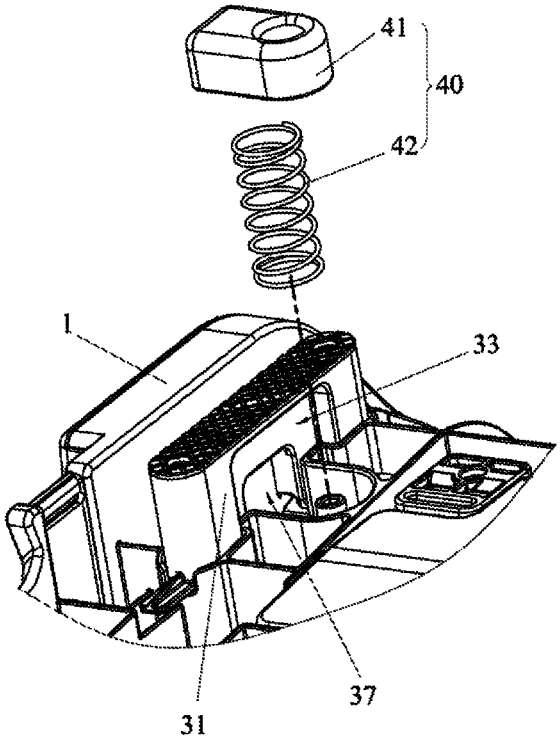
FIG. 4 is a fragmentary exploded perspective view of the seat body and an unlocked-state retention device of the preferred embodiment.
Figure 5:
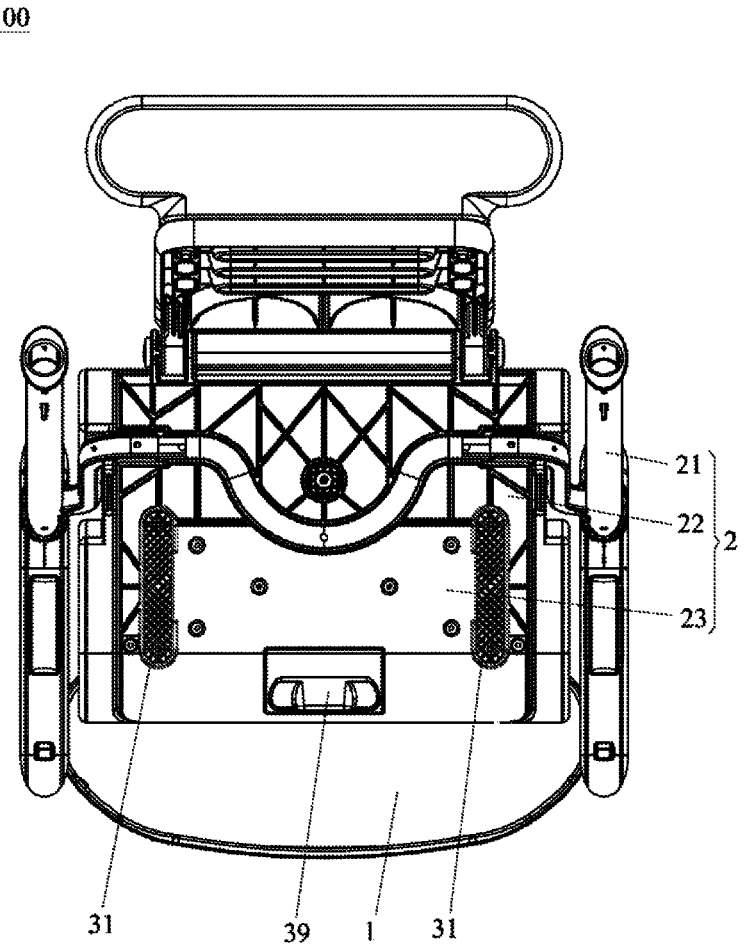
FIG. 5 is a bottom view of the seat assembly of the preferred embodiment.

Referring to FIGS. 4 and 7, the column body 31 further has a restricting groove 37 that is indented from the column side surface thereof. The push member 41 of each pusher 40 extends partially into the restricting groove 37 of the column body 31 of the respective one of the locking units 3 such that the push member 41 is restricted from projecting from the bottom surface of the seat body 1 beyond a limited distance. In this embodiment, the locking groove 33 is in spatial communication with the restricting groove 37 in the same column body 31.

Each of the locking units 3 further includes a second resilient member 38 that is connected between the tongue 34 and the base frame 2 for biasing the tongue 34 toward the projecting position. The second resilient member 38 is configured as a spring. The distal portion of the tongue 34 is wedge-shaped and has an inclined upper surface 35 that has a lower distal edge, such that when the column body 31 moves downwardly in the socket 32, the column body 31 contacts slidably the inclined upper surface 35 to push the tongue 34 to the retracted position.

Referring to FIG. 6, the seat assembly 100 further includes an operating member 39 that is mounted slidably in the base frame 2 for operating the tongues 34 of the locking units 3 between the projecting position and the retracted position. The operating member 39 slides in a direction perpendicular to that of the tongues 34. The operating member 39 is formed with two elongate pin holes 391 that respectively extend in two inclined directions, each of which is inclined with respect to the two perpendicular directions. Bach of the locking units 3 further includes a sliding pin 36 that is connected co-movably to the tongue 34, and that connects pivotally the tongue 34 to the operating member 39. The sliding pin 36 extends slidably through a respective one of the elongate pin holes 391.

To separate the seat body 1 from the base frame 2, a user moves the tongues 34 to the retracted position against the resilient force of the second resilient members 38 by pressing the operating member 39. Subsequently, the push members 41 of the pushers 40 project from the bottom surface of the seat body 1 to push the base frame 2 away from the seat body 1 and the unlocked-state retention device 4 prevents the seat body 1 from moving to the locked state. It is convenient for the user to remove the seat body 1 from the base frame 2 since retention of tongues 34 at the retracted position and removal of the seat body 1 do not need to foe performed simultaneously.

It is noted that the unlocked-state retention device 4 may be disposed movably in the base frame 2. Moreover, for each of the locking units 3, the socket 32 may be formed in the bottom surface of the seat body 1, the column body 31 may project upwardly from the upper surface of the base frame 2, and the tongue 34 may be mounted slidably in the seat body 1.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A seat assembly comprising:

a base frame;

a seat body removably mounted on said base frame;

a locking unit that releasably interlocks said base frame and said seat body when said seat body is mounted on said base frame, said locking unit being operable to lock said seat body relative to said base frame so that said seat body is placed in a locked state, where said seat body is irremovable from said base frame, or to unlock said seat body relative to said base frame so that said seat body is placed in an unlocked state, where said seat body is removable from said base frame; and an unlocked-state retention device that separates said seat body from said base frame and thereby prevents said seat body from moving to the locked state when said seat body is in the unlocked state, wherein:

said locking unit has a socket formed in an upper surface of said base frame, a column body that projects downwardly from a bottom surface of said seat body and extends into said socket when said seat body is disposed on said upper surface of said base frame, and tongue that is mounted slidably in said base frame and operable to move between a projecting position where a distal portion of said ton ue projects into said socket, and a retracted position where said distal portion of said tongue is retracted from said socket, and said column body has a locking groove that is engaged with said tongue to place said seat body in the locked state when said distal portion of said tongue is at the projecting position, wherein said unlocked-state retention device includes a pusher that is disposed movably in said seat body and includes a push member to retractably project from said bottom surface of said seat body and to push said upper surface of said base frame when said seat body is in the unlocked state, wherein said pusher further includes a first resilient member disposed between said push member and said seat body to urge said push member when said seat body is in the unlocked state, said push member being retracted into said seat body when said seat body is in the locked state, and wherein:

said push member is disposed in proximity to said column body;

said column body further has a column bottom surface that is opposite to said bottom surface of said seat body, and a column side surface that extends from said column bottom surface to said bottom surface of said seat body and that is formed with said locking groove;

said column body further has a restricting groove that is indented from said column side surface; and said push member extends partially into said restricting groove such that said push member is restricted from projecting from said bottom surface of said seat body beyond a limited distance.

2. The seat assembly as claimed in claim 1, wherein said locking groove is indented from said column side surface and is in spatial communication with said restricting groove.

3. The seat assembly as claimed in claim 1, wherein said distal portion of said tongue is wedge-shaped.

4. The seat assembly as claimed in claim 3, wherein said locking unit further includes a second resilient member that is disposed between said tongue and said base frame for biasing said tongue toward the projecting position.

5. The seat assembly as claimed in claim 4, wherein said second resilient member is configured as a spring.

6. The seat assembly as claimed in claim 5, further comprising an operating member that is mounted slidably in said base frame for operating said tongue between the projecting position and the retracted position.

7. The seat assembly as claimed in claim 1, wherein said unlocked-state retention device includes two of said pushers that are disposed respectively at left and right sides of said seat body.

8. The seat assembly as claimed in claim 7, wherein said base frame includes a main frame, a base body mounted on said main frame to support said seat body, and a cover plate mounted under said base body.

9. A seat assembly, comprising:

a base frame;

a seat body removably mounted on said base frame;

a locking unit that releasably interlocks said base frame and said seat body and operable to lock said seat body relative to said base frame so that said seat body is placed in a locked state, where said seat body is irremovable from said base frame, or to unlock said seat body relative to said base frame so that said seat body is placed in an unlocked state, where said seat body is removable from said base frame, an unlocked-state retention device that separates said seat body from said base frame, and thereby prevents said seat body from moving to the locked state when said seat body is in the unlocked state;

an operating member mounted slidably in said base frame for operating said tongue between the projecting position and the retracted position wherein:

said locking unit has a socket that is formed in an upper surface of said base frame, a column body that projects downwardly from a bottom surface of said seat body and that extends into said socket when said seat body is disposed on said upper surface of said base frame, and a tongue that is mounted slidably in said base frame and operable to move between a projecting position where a distal portion of said tongue projects into said socket and a retracted position where said distal portion of said tongue is retracted from said socket, and said column body has a locking groove that is engaged with said tongue to place said seat body in the locked state when said distal portion of said tongue is at the projecting position, wherein said distal portion of said tongue is wedge-shaped, wherein said locking unit further includes a second resilient member disposed between said tongue and said base frame for biasing said tongue toward the projecting position, wherein said second resilient member is configured as a spring, and wherein said operating member and said tongue slide respectively in two perpendicular directions, said operating member being formed with an elongate pin hole that extends in a direction inclined with respect to the two perpendicular directions, said locking unit further including a sliding pin that is connected co-movably to said tongue and that connects pivotally said tongue to said operating member, said sliding pin extending slidably through said elongate pin hole.

* * * * *